US010400430B2

(12) United States Patent
Zhang et al.

(10) Patent No.: US 10,400,430 B2
(45) Date of Patent: Sep. 3, 2019

(54) HANGING STRUCTURE FOR DETACHABLY HANGING A HAND-HELD SHOWER HEAD

(71) Applicant: XIAMEN SOLEX HIGH-TECH INDUSTRIES CO., LTD., Xiamen, Fujian (CN)

(72) Inventors: Yonghui Zhang, Fujian (CN); Donghai Chen, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

(21) Appl. No.: 15/802,079

(22) Filed: Nov. 2, 2017

(65) Prior Publication Data

US 2018/0313070 A1 Nov. 1, 2018

(30) Foreign Application Priority Data

Apr. 28, 2017 (CN) ..... 2017 1 0294249

(51) Int. Cl.
*E03C 1/06* (2006.01)
*B05B 1/00* (2006.01)

(52) U.S. Cl.
CPC . *E03C 1/06* (2013.01); *B05B 1/00* (2013.01)

(58) Field of Classification Search
CPC ..... E03C 1/06
USPC ..... 4/596–614
See application file for complete search history.

(56) References Cited

U.S. PATENT DOCUMENTS 4,458,369 A * 7/1984 Santi ..... E03C 1/06 4/596
4,719,654 A * 1/1988 Blessing ..... E03C 1/06 4/597
D323,205 S * 1/1992 Klose ..... E03C 1/06 D23/222
D332,994 S * 2/1993 Huen ..... E03C 1/06 D23/223
7,814,585 B1 * 10/2010 Reich ..... A47K 3/022 4/567
7,937,784 B2 * 5/2011 Qiu ..... B05B 1/1618 4/661
D639,391 S * 6/2011 Yongyan ..... E03C 1/06 D23/228
2018/0065131 A1 * 3/2018 Rogers ..... B05B 1/1627

* cited by examiner

*Primary Examiner* — Lori L Baker
(74) *Attorney, Agent, or Firm* — Rabin & Berdo, P.C.

(57) ABSTRACT

A hanging structure configured to detachably hang a hand-held shower head having a rear side disposed with a hanging ridge that extends longitudinally and has a convex cross section that tapers down in width from a top end to an insertion end, includes a hanging structure having a front side disposed with a hanging groove extending in an insertion direction, having two side walls defining a small entrance, and having a concave cross section that tapers down in width from an insertion opening to a restricting end portion. The concave cross section of the hanging groove removably accommodates the convex cross section of the hanging ridge when the insertion end of the hanging ridge is inserted into the insertion opening of the hanging groove and slid in the insertion direction within the hanging groove down to the restricting end portion so that insertion depth of the hanging ridge is restricted.

15 Claims, 8 Drawing Sheets

HANGING STRUCTURE FOR DETACHABLY HANGING A HAND-HELD SHOWER HEAD

FIELD OF THE INVENTION

The present invention relates to a detachable hanging structure for hanging a hand shower head and a detachable hanging structure.

BACKGROUND OF THE INVENTION

Existing detachable hanging structure for hanging a hand shower head comprises a for-hanging structure and a hand shower head; the front side of the for-hanging structure is concaved with a hanging groove running throughout in the hanging direction; the hand shower head comprises a head portion and a handle portion fixed to the head portion; the handle portion can be inserted to the hanging groove to achieve hanging. The existing detachable hanging structures have following shortcomings: 1. the handle portion is inserted to the hanging groove, so when a user wants to hang the hand shower head or pull the hand shower head out, he or she needs to handle the head portion of the hand shower head, moves his or her hand from the handle portion to the hear portion to insert or from the head portion to the handle portion to pull the shower head out; the for-hanging structure is inconvenient to use; 2. The hand shower head is inserted behind the hanging groove, making the hanging groove exposed and the structure unattractive.

SUMMARY OF THE INVENTION

The present invention is provided with a detachable hanging structure for hanging a hand shower head and a detachable hanging structure, which overcome the shortcomings of the existing known technology.

A first technical solution of the present invention is that:

A detachable hanging structure for hanging a hand shower head, comprising a for-hanging structure and a hand shower head, wherein the front side of the for-hanging structure is disposed with a hanging groove in the hanging direction; the hanging groove is V shaped with big end up and has small entrance and big middle part in the forward and backward directions; the rear side of the hand shower head is fixedly disposed with a hanging portion or is formed with a hanging portion; the hanging portion is V shaped with big end up in the hanging direction and has narrow front and wide rear in the forward and backward directions; the hanging portion of the hand shower head can insert to the hanging groove in the hanging direction; V shaped structure of the hanging groove is coupled to the V shaped structure of the hanging portion to restrict the inserting depth of the hanging portion and to enable the hand shower head hanging to the for-hanging structure; the small entrance and big middle part structure is coupled to the narrow front and wide rear structure so as to enable the hand shower head only inserting into and pulling out of the for-hanging structure in the hanging direction.

In another preferred embodiment, the right and left sides of the hanging portion are respectively protruding with a protruding block, which is supported on an end face of the for-hanging structure; V shaped structure of the hanging groove is coupled to the V shaped structure of the hanging portion; the small entrance and big middle part structure is coupled to the narrow front and wide rear structure.

In another preferred embodiment, the groove wall of the hanging groove is arc shaped with axis at the front; the rear side of the hanging portion is arc shaped with axis at the front; the arc surfaces are coupled to each other.

In another preferred embodiment, the front side of the for-hanging structure is arc shaped with axis at the front; the rear side of the hanging portion of the hand shower head is arc shaped with axis at the front; the arc surfaces are coupled to each other.

In another preferred embodiment, the hanging groove has deep top and shallow end in the forward and backward directions, the height of the hanging portion is coupled to the depth of the hanging groove.

In another preferred embodiment, the hanging groove and the hanging portion are bilateral symmetrical in relation to the hanging direction.

In another preferred embodiment, the top end of the hanging portion extends to the periphery of the head portion of the hand shower head; the bottom end of the hanging portion extends to the handling portion of the hand shower head.

In another preferred embodiment, further comprising a for-hanging shower head 40 and a holder 50 assembled at the lower portion of the for-hanging shower head 40, the for-hanging structure 10 is fixed to the holder 50, and the for-hanging shower head 40 is a top shower head 40 or a raining-like shower head 40.

A second technical solution of the present invention is that:

A detachable hanging structure, comprising a for-hanging structure and a hanging structure, wherein the front side of the for-hanging structure is concaved with a hanging groove in the hanging direction; the hanging groove is V shaped with big end up and has small entrance and big middle part in the forward and backward directions; the rear side of the hand shower head is fixedly disposed or is formed with a hanging portion; the hanging portion is V shaped with big end up in the hanging direction and has narrow front and wide rear in the forward and backward directions; the right and left sides of the hanging portion are respectively protruding with a protruding block, the hanging portion of the hanging structure can insert to the hanging groove until the protrudings are supported on an end face of the for-hanging structure; V shaped structure of the hanging groove is coupled to the V shaped structure of the hanging portion to restrict the inserting depth of the hanging portion and to achieve the hand shower head hanging to the for-hanging structure; the small entrance and big middle part structure is coupled to the narrow front and wide rear structure so as to enable the hanging structure only inserting into and pulling out of the for-hanging structure in the hanging direction.

In another preferred embodiment, the front side of the for-hanging structure is arc shaped with axis at the front; the rear side of the hanging structure is arc shaped with axis at the front; the arc surfaces are movably coupled to each other.

In another preferred embodiment, the hanging groove has deep top and shallow end in the forward and backward directions, the height of the hanging portion is coupled to the depth of the hanging groove.

In another preferred embodiment, the hanging groove and the hanging portion are bilateral symmetrical in relation to the hanging direction.

A third technical solution of the present invention is that:

A detachable hanging structure, comprising a for-hanging structure and a hanging structure, wherein the front side of the for-hanging structure is concaved with a hanging groove in the hanging direction; the hanging groove is V shaped with big end up and has small entrance and big middle part in the forward and backward directions; the front side of the for-hanging structure is arc shaped with axis at the front; the rear side of the hand shower head is fixedly disposed or is formed with a hanging portion; the hanging portion is V shaped with big end up in the hanging direction and has narrow front and wide rear in the forward and backward directions; the rear side of the hanging structure is arc shaped with axis at the front; the arc surfaces are movably coupled to each other; the hanging portion of the hanging structure can insert to the hanging groove; V shaped structure of the hanging groove is coupled to the V shaped structure of the hanging portion to restrict the inserting depth of the hanging portion and to achieve the hand shower head hanging to the for-hanging structure; the small entrance and big middle part structure is coupled to the narrow front and wide rear structure so as to enable the hanging structure only inserting into and pulling out of the for-hanging structure in the hanging direction.

In another preferred embodiment, the hanging groove has deep top and shallow end in the forward and backward directions, the height of the hanging portion is coupled to the depth of the hanging groove.

In another preferred embodiment, the hanging groove and the hanging portion are bilateral symmetrical in relation to the hanging direction.

Compared to the existing known technology, the present invention has advantages as follows:

On one hand, the hanging portion of the hand shower head can insert to the hanging groove in the hanging direction; V shape structure of the hanging groove is coupled to the V shape structure of the hanging portion to restrict the inserting depth of the hanging portion and realizing the hand shower head heading to the hanging groove; the small entrance and big middle structure is coupled to the narrow front and wide rear structure to allow the hand shower head only inserting in or pulling out in the hanging direction; the inserting is convenient and fast and the shower head is put in and pulled out conveniently; the manufacturing cost is low; the hanging groove is covered by the hand shower head after being inserted, making the appearance attractive. On the other hand, the hanging portion is disposed at the rear side of the head portion of the hand shower head, making that the hand shower head does not need to take long route to hang to the for-hanging structure and the for-hanging structure is more closed to the head shower head, thus providing completeness after the hand shower head is hanging to the head shower head.

The hanging portion of the hanging structure is inserted to the hanging groove in the hanging direction until the protruding is supported on the end face of the hanging structure. V shape structure of the hanging groove is coupled to the V shape structure of the hanging portion to restrict the inserting depth of the hanging portion and to realize the hanging portion hanging to the hanging groove. The small entrance and big middle structure is coupled to the narrow front and wide rear structure to allow the hanging structure only insert into or pull out in the hanging direction. The protruding is coupled to the end face of the hanging structure to restrict the hand shower head from moving downward and prevent tightly inserting and problem of pulling out.

The arc surface of the hanging structure is coupled to the arc surface of the hand shower head; the hanging portion of the hanging structure is inserted to the hanging groove in the hanging direction; V shape structure of the hanging groove is coupled to the V shape structure of the hanging portion to restrict the inserting depth of the hanging portion and to realize the hanging portion hanging to the hanging groove; the small entrance and big middle structure is coupled to the narrow front and wide rear structure to allow the hanging structure only insert into or pull out in the hanging direction.

BRIEF DESCRIPTION OF THE DRAWINGS

The present invention will be further described with the drawings and the embodiments.

DETAILED DESCRIPTION OF THE EMBODIMENTS

Figure 1:
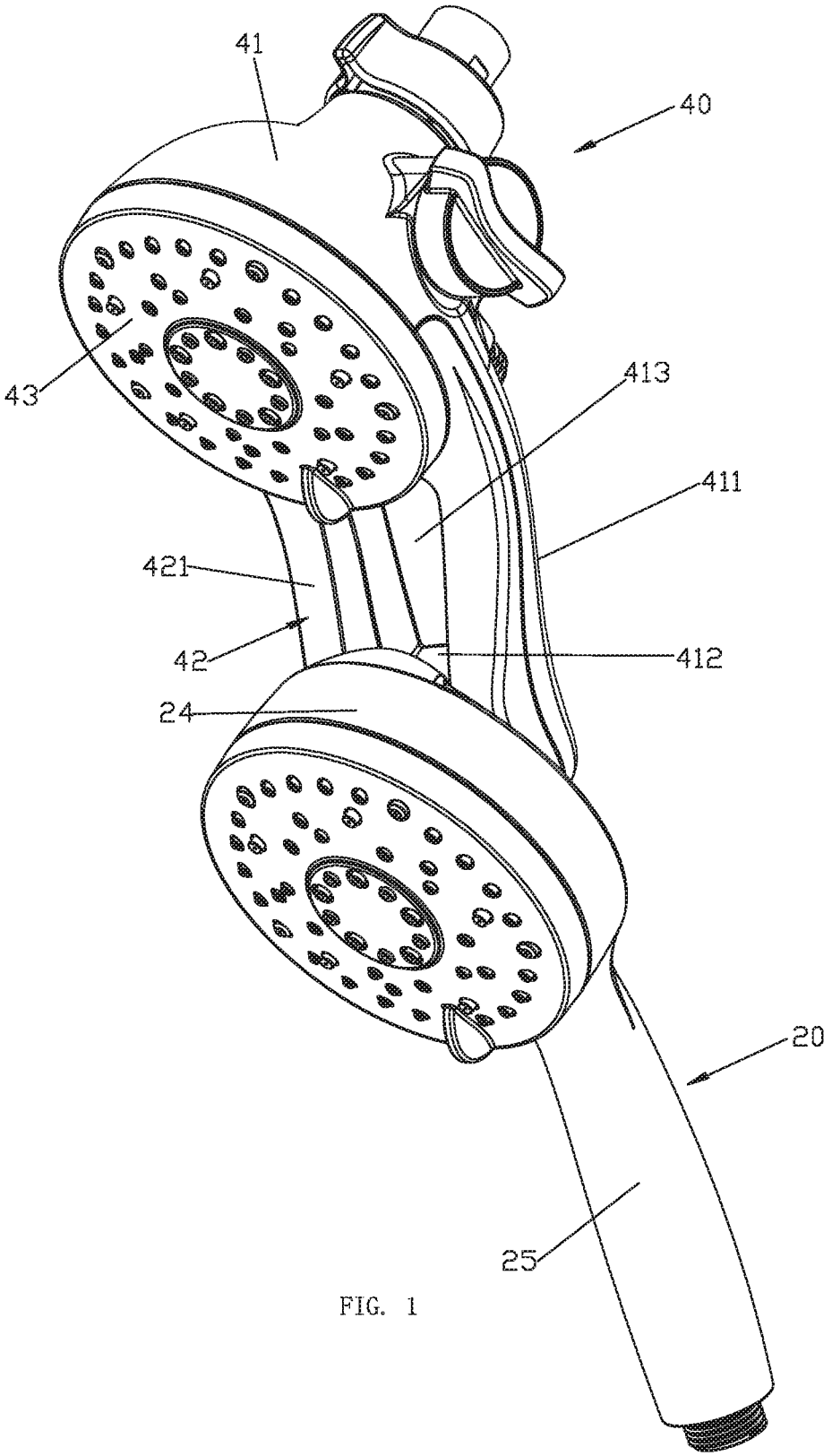
FIG. 1 illustrates a schematic diagram of a hand shower head hanging to a head shower head.
Figure 2:
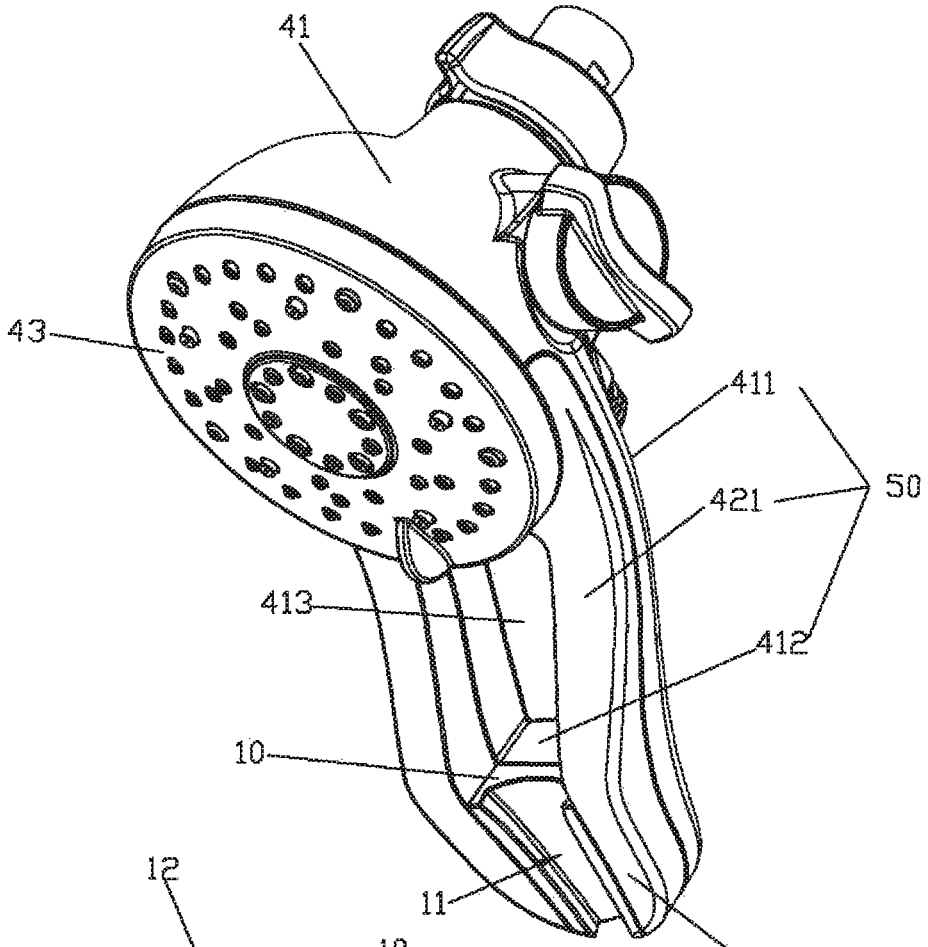
FIG. 2 illustrates a schematic diagram of the head shower head.
Figure 3:
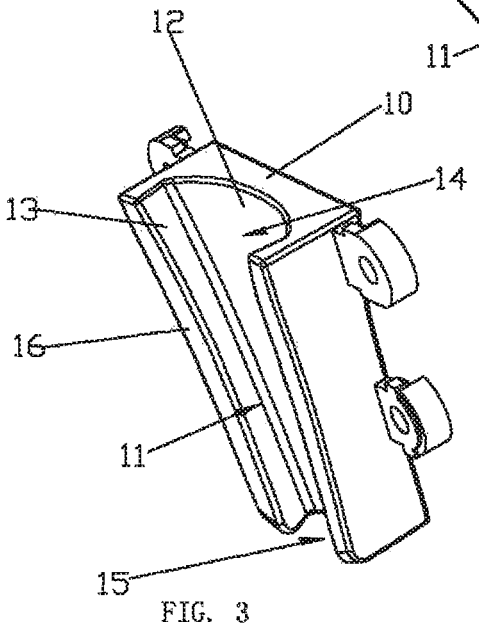
FIG. 3 illustrates a schematic diagram of the for-hanging structure.
Figure 4:
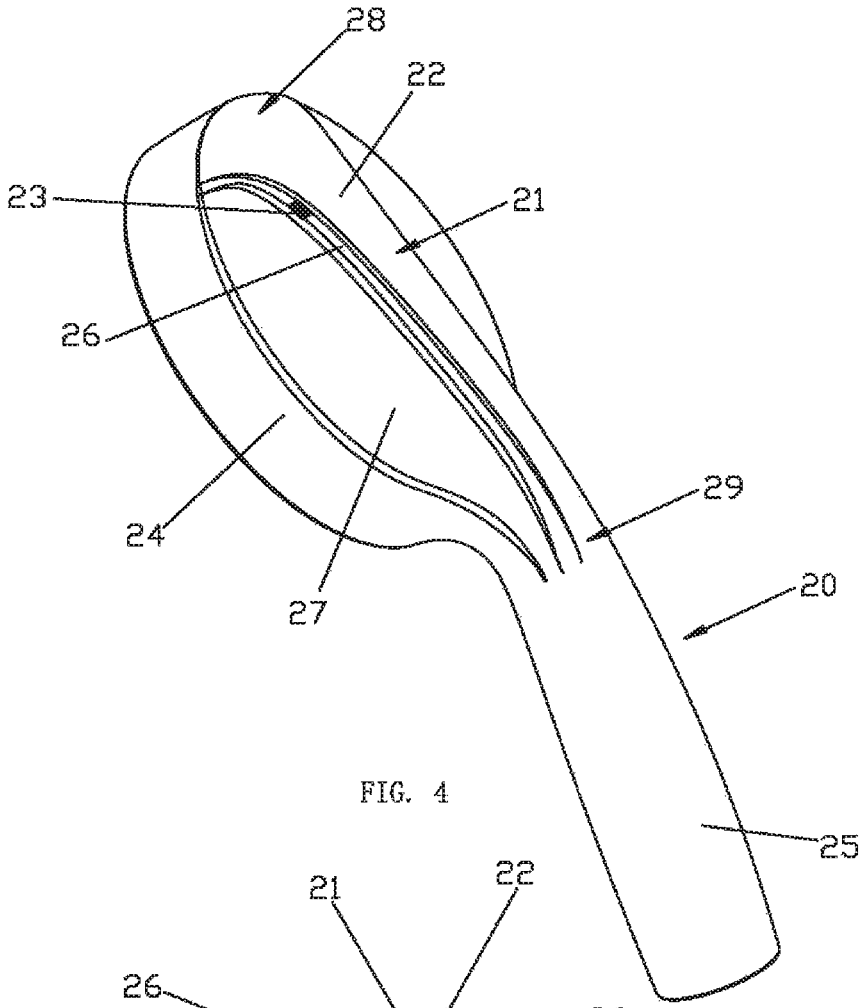
FIG. 4 illustrates a schematic diagram of the hand shower head.
Figure 5:
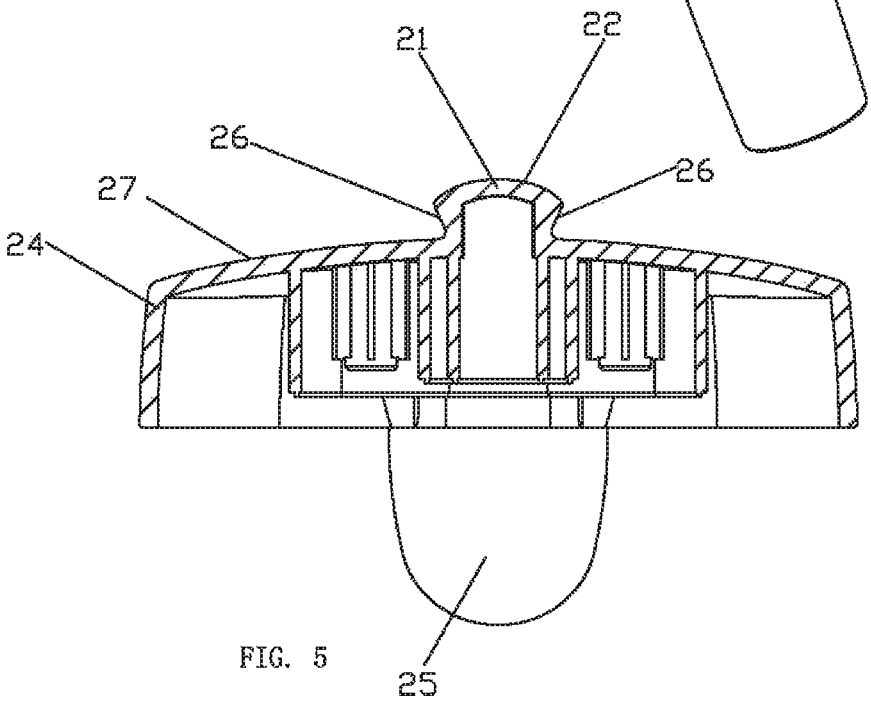
FIG. 5 illustrates a transverse section diagram of the hand shower head.
Figure 6:
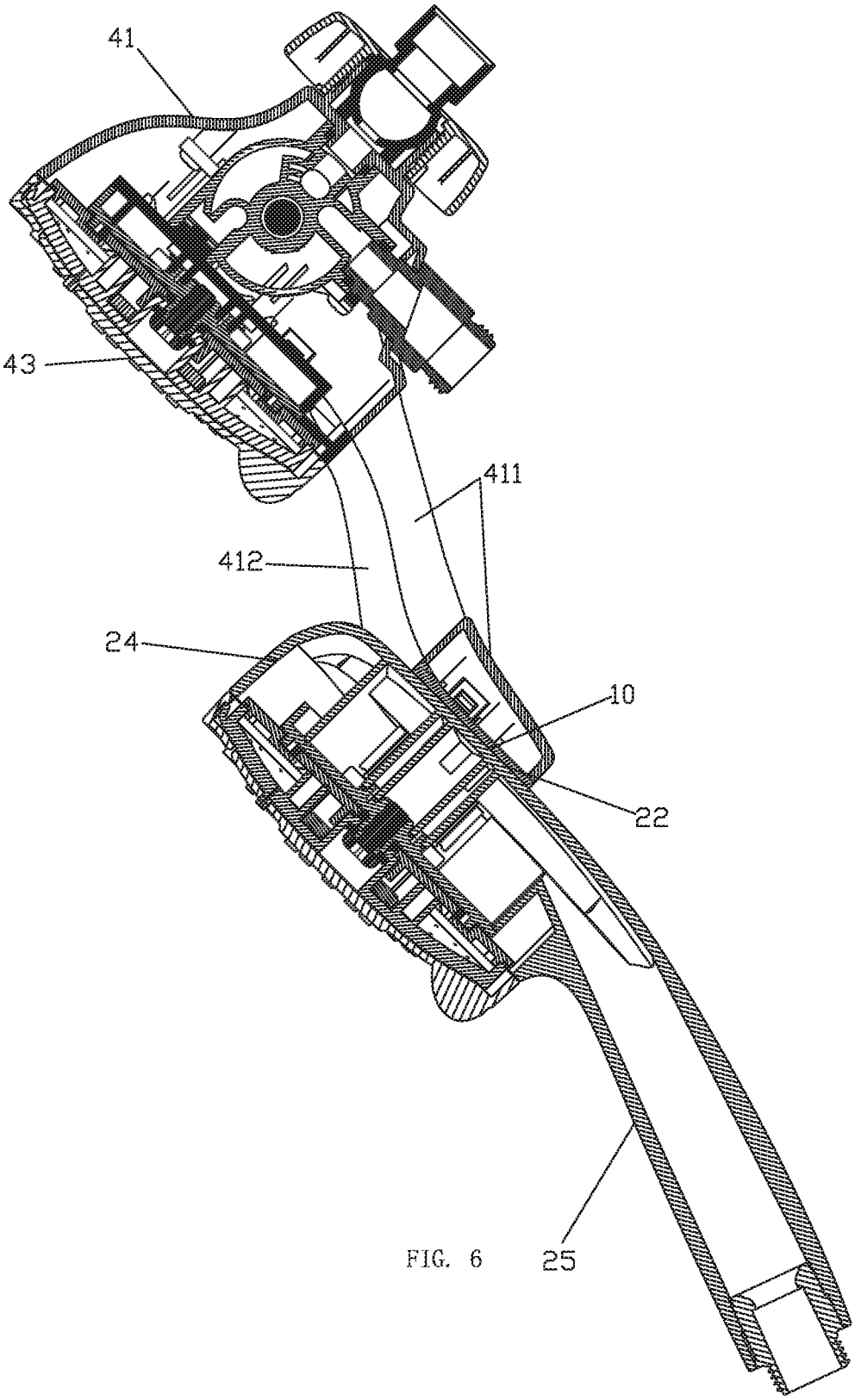
FIG. 6 illustrates a longitudinal section diagram of the hand shower head hanging to the head shower head.
Figure 7:
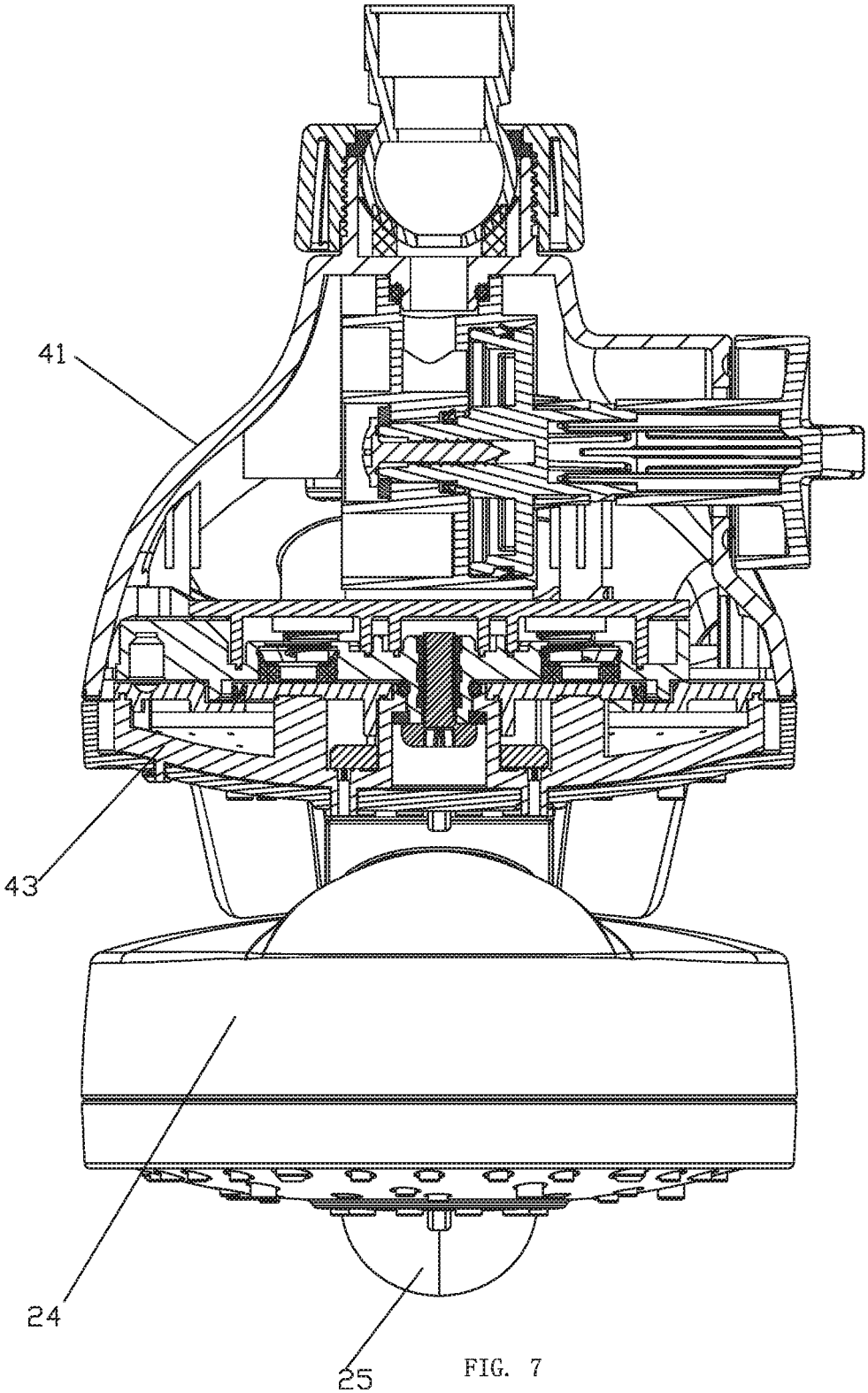
FIG. 7 illustrates a transverse section diagram of the hand shower head hanging to the head shower head.
Figure 8:
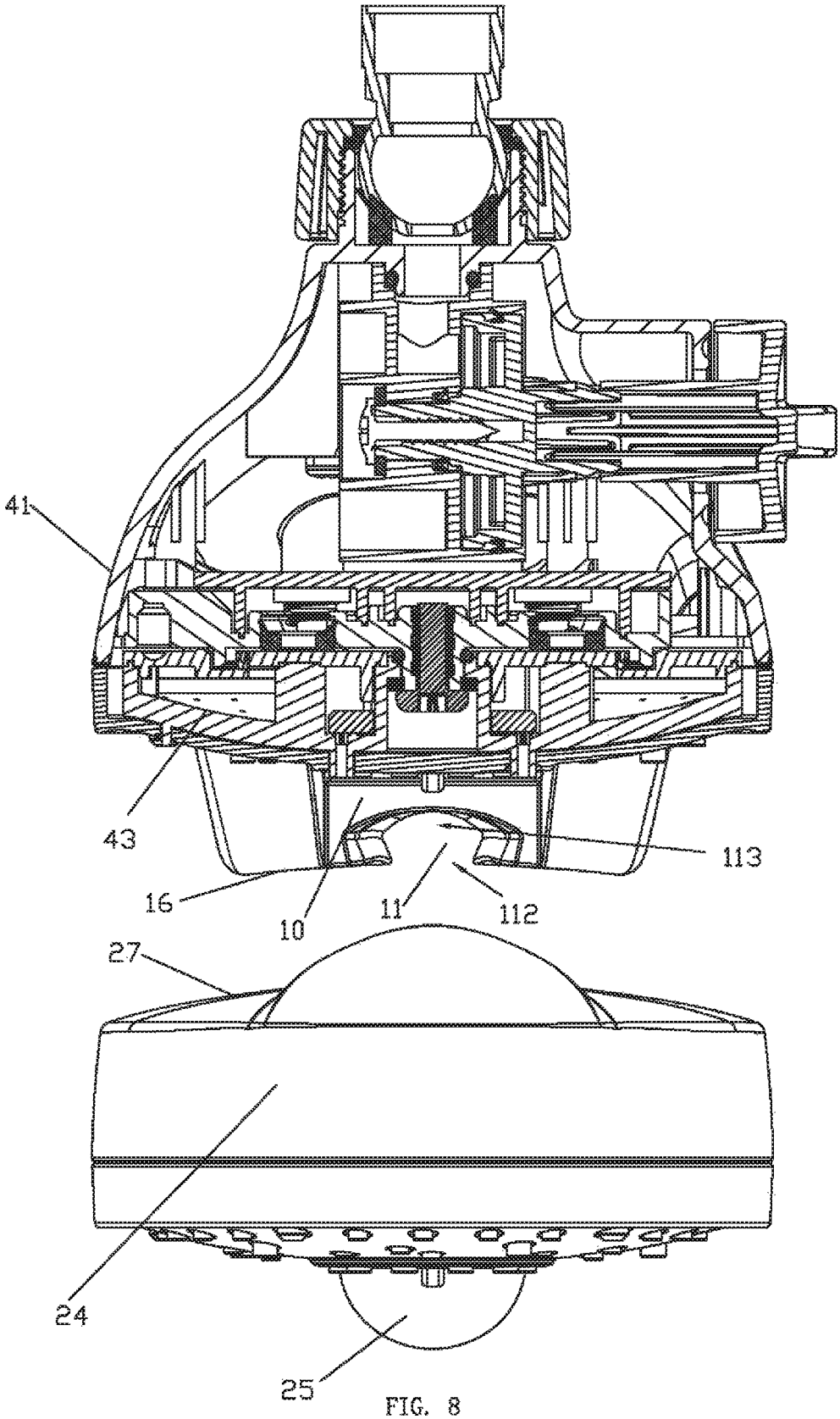
FIG. 8 illustrates a transverse section diagram of the hand shower head and the head shower head in separating state.
Figure 9:
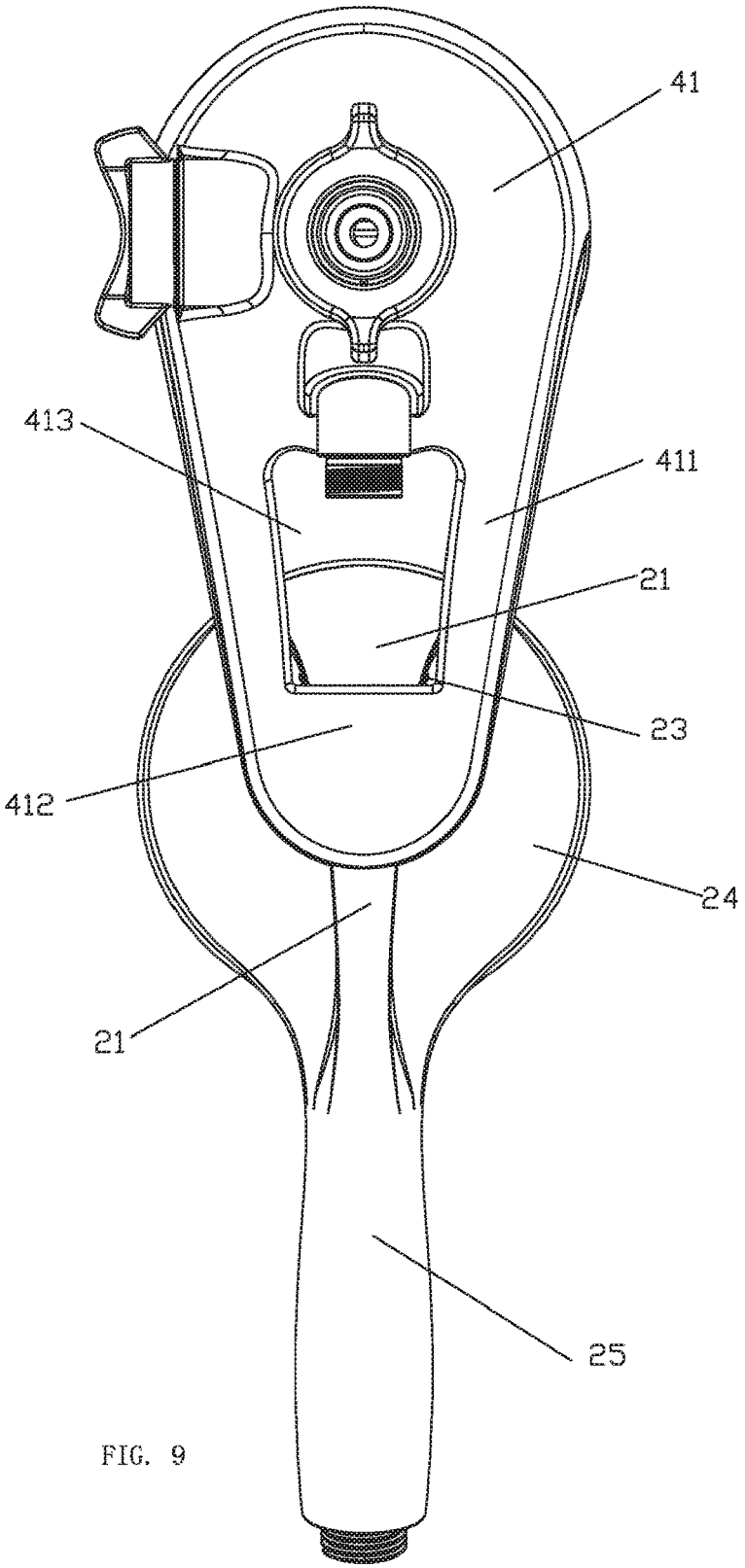
FIG. 9 illustrates a rear view of the hand shower head hanging to the head shower head.
Figure 10:
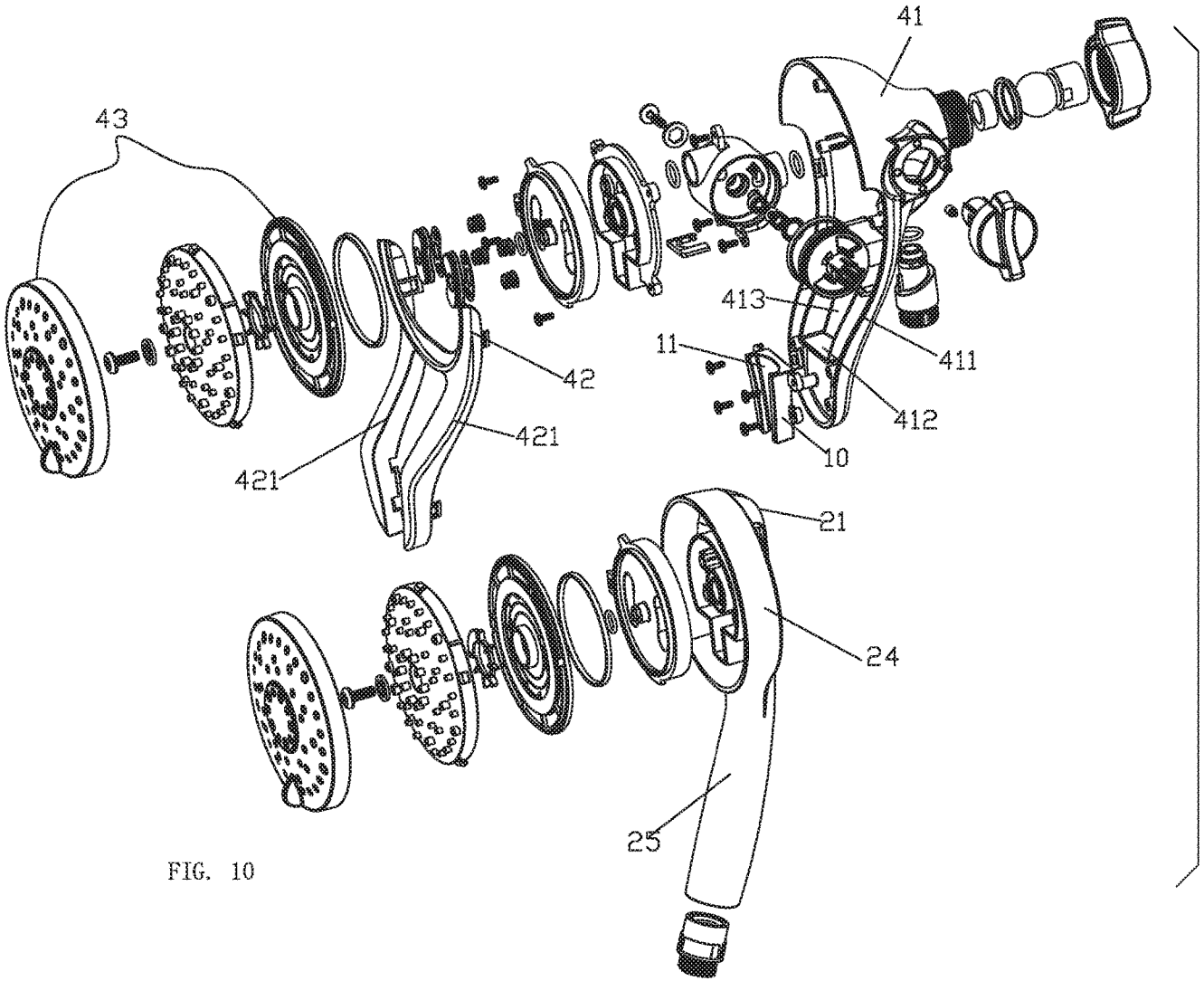
FIG. 10 illustrates an exploded diagram of the hand shower head and the head shower head.

Referring to FIGS. 1-10, a detachable hanging structure for hanging a hand-held shower head comprises a for-hanging, hanging structure 10 and a hand-held shower head 2. A front side 16 of the hanging structure 10 is concave in cross section with a hanging groove 11 defined in a hanging direction, i.e., an insertion direction, and having a concave cross section that tapers down in width from an insertion opening 14 to a restricting end portion 15. The hanging groove 11 is overall V-shaped with a big end of the V up and with a small entrance 112 and big middle portion 113 in the forward and backward directions. A rear side 27 of the hand-held shower head 20 is fixedly disposed with a hanging portion 21, i.e., a hanging ridge 21, or is integrally formed with a hanging portion 21, i.e., the hanging ridge 21. The hanging portion 21 is convex in cross section and tapers down in width from a top end 28 to an insertion end 29 and is overall V-shaped with the big end of the V up in the hanging direction and with a narrow front and wide rear in the forward and backward directions. The hanging portion 21 of the hand-held shower head 20 can be inserted into the hanging groove 11 in the hanging direction, i.e., in an insertion direction. Then, the V-shaped structure of the hanging groove 11 is coupled to, i.e., retainingly engages, the V-shaped structure of the hanging portion 21 to restrict the insertion depth of the hanging portion 21 and to enable the hand-held shower head 20 to be detachably hung by hanging structure 10. The small entrance and big middle part structure of the hanging structure 10 couples, i.e., retainingly engages, the narrow front and wide rear structure of the hanging portion 21 so as to enable the hand-held shower head 20 to be only inserted into the hanging structure 10 in the hanging direction and removed from the hanging structure 10 in a removal direction that is opposite to the insertion direction, therefore realizing lateral lock and the hand-held shower head 20 hanging from the hanging structure 10. The hanging groove 11 and the hanging portion 21 are bilaterally symmetrical in relation to the hanging direction, providing convenience for manufacturing and assembling the structure.

The right and left sides of the hanging portion 21 are respectively protruding with a protruding block 23; the handing portion 21 of the hand shower head 20 is inserted to the hanging groove 11 in the hanging direction until the protrudings are supported on an end face of the for-hanging structure 10; V shaped structure of the hanging groove 11 is coupled to the V shaped structure of the hanging portion 21; the small entrance and big middle part structure is coupled to the narrow front and wide rear structure. The cooperation of the protrudings 23 and the end face of the for-hanging structure to restrict the hand shower head 20 from moving downward and prevent tightly inserting and problem of pulling out.

A groove bottom 12 of the hanging groove 11 is arc shaped with axis at the front; the rear side 22 of the hanging portion 21 is arc shaped with axis at the front. The front side of the for-hanging structure 10 is arc shaped with axis at the front; the arc surface of the front side 16 of the for-hanging structure 10 is movably coupled to the arc surface of the rear side 22 of the hand shower head 20; the movably coupling comprises at least that the semi-diameter of the arc surface of the rear side 22 of the hand shower head 20 is smaller than that of arc surface of the front side of the for-hanging structure 10; the axis of the arc surface is parallel to the inserting direction. With the arc surface, the hanging portion 21 of the hand shower head 20 is movable conveniently along the arc surface of the front side of the for-hanging structure 10, making that the hanging portion 21 of the head shower head 20 is led to the center portion of the handing groove 11 of the for-hanging structure 10 when aiming to the hanging groove 11.

Preferred, the hanging groove 11 has deep top and shallow end in the forward and backward directions, and the height of the hanging portion 21 is coupled to the depth of the hanging groove, thus ensuring a highly stably inserting and automatic leading and aligning conveniently when the hanging portion 21 is inserted to the hanging portion 21.

In this embodiment, the hanging groove 11 is disposed with a groove bottom 12 and two groove walls 13 at two sides of the groove bottom 12; the distance between the two groove walls 13 is gradually decreased from the groove bottom 12 to the groove wall, making two groove wall 13 form two sides of a isosceles trapezoid in the lateral section, forming a small entrance and big middle structure. The hanging portion 21 is disposed with a rear side 22 and two sides 26 respectively connected to the rear side 22; the distance between the two sides is gradually decreased from the rear side 22 to the bottom end of the hanging portion 21, making the two sides form two sides of a isosceles trapezoid in the lateral section, forming a narrow front and wide rear.

The top end of the rear side 22 of the hanging portion 21 extends to the periphery of the head portion 24 of the hand shower head 20; the bottom end of rear side 22 of the hanging portion 21 extends to the handling portion 25 of the hand shower head 20, thus improving the product strength and providing an attractive appearance.

The for-hanging structure 10 is fixed to or is formed at the lower portion of the head shower head 30 by a rack. In detailed, the for-hanging shower head is disposed with a rear cover 41, a front rack 42 and a front cover plate 43, which are fixed connected to form an accommodating chamber; the accommodating chamber is assembled with a switch valve, an outlet component, etc. The bottom portion of the rear cover 41 is formed with two forked elements 411 and a common portion 412 fixed to the lower portion of the two forked rear elements 411, making the lower portion of the rear cover 41 and the upper portion of the common portion 412 form a rear throughout portion 413 between the two forked rear elements 411. The front rack 42 is formed with two forked front elements 412 arranged with spaced and being disposed with a portion corresponding to the rear throughout portion 413. The rear cover 41 and the front rack 42 are coupled to form above mentioned rack; the front side of the front rack 42 and the front side 16 of the for-hanging structure 10 are arc shape structures in the same arc for the inserting and leading of the hand shower head. The for-hanging structure 10 is fixed to the common portion 412 and the hanging groove 11 is corresponding to the space between the two forked front elements 421. With this configuration, the present invention is easily assembled and has attractive appearance. The hanging portion is disposed at the rear side of the head portion of the hand shower head, making that the hand shower head does not need to take long route to hang to the for-hanging structure and the for-hanging structure is more closed to the head shower head, thus providing completeness after the hand shower head is hanging to the head shower head.

Hereafter describes how to hang the hand shower head: aiming the lower end portion of the hanging portion 21 of the hand shower head 20 to the hanging groove 11 of the head shower head 40, then taking the hand shower head 20 down to make the hand shower head 20 inserted to the hanging groove 11 along the hanging groove 11. With the V shape structure, the hand shower head will not fall down but is locked to the hanging groove 11; with the small entrance and large middle structure of the hanging groove 11 and the narrow front and wide rear structure of the hanging portion 21, the hand shower head will not drop out from the front but is hooked by the hanging groove 11; therefore, the hand shower head 20 is limited and fixed by the hanging groove 11 from the lower portion and the front portion.

Hereafter describes how to take the hand shower head out: when the hand shower head 20 is fixed to the head shower head 40, just needing to hold the handle portion 25 of the hand shower head 20 and putting a push force F up along the hanging groove 11; when the width of the hanging portion 21 of the hand shower head 20 is smaller than that of the hanging groove 11, the hanging groove 11 will not hook to the hanging portion 21 that the hand shower head 20 leaves from the head shower head 40.

Although the prevent invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A hanging structure configured to detachably hang a hand-held shower head having a rear side disposed with a hanging ridge that extends longitudinally and that has a convex cross section that tapers down in width from a top end to an insertion end, comprising:

a hanging structure having a front side that is disposed with a hanging groove extending in an insertion direction, having a concave cross section that tapers down in width from an insertion opening to a restricting end portion, and having two side walls that define an entrance for the hanging groove in the forward and backward directions to retain the hanging ridge, the entrance opening into a middle portion of the hanging groove and having a width in cross section that is narrower than that of the middle portion, wherein the concave cross section of the hanging groove removably accommodates the convex cross section of the hanging ridge when the insertion end of the hanging ridge is inserted into the insertion opening of the hanging groove and slid in the insertion direction within the hanging groove down to the restricting end portion thereof so that insertion depth of the hanging ridge into the hanging groove is restricted, so that the insertion direction is restricted, and so that a removal direction of the hanging ridge from the hanging groove is opposite the insertion direction.

2. The hanging structure according to claim 1, wherein the two groove walls of the hanging groove taper inwardly for retaining the hanging ridge when engaged, and wherein the hanging ridge has right and left sides that protrude and engage a respective groove wall of the two groove walls and at least one protruding block disposed on the hanging ridge that engages the hanging groove in a manner to restrict the insertion depth.

3. The hanging structure according to claim 1, wherein the hanging groove has a groove bottom that is arc shaped with an axis at the front, a rear side of the hanging ridge is arc shaped with an axis at the front, and the arc shaped groove bottom and the arc shaped rear side of the hanging ridge engage one another.

4. The hanging structure according to claim 1, wherein the front side of the hanging structure is arc shaped with an axis at the front, the rear side of the hanging ridge of the hand-held shower head is arc shaped with an axis at the front, and the arc shaped front side of the hanging structure and the arc shaped rear side of the hanging ridge engage one another.

5. The hanging structure according to claim 1, wherein the hanging groove has a depth from the insertion opening to the restricting end portion, and wherein the top end of the hanging ridge has a height above the hanging groove that is determined by the depth of the hanging groove.

6. The hanging structure according to claim 1, wherein the hanging groove and the hanging ridge are bilaterally symmetrical in relation to the insertion direction.

7. The hanging structure according to claim 1, wherein the hand-held shower head has a head portion and a handle portion, wherein the top end of the hanging ridge extends to a periphery of the head portion of the hand-held shower head and the insertion end of the hanging ridge extends to the handle portion of the hand shower head.

8. The hanging structure according to claim 1, further comprising another shower head having a holder disposed at a lower portion of the another shower head onto which the hanging structure is mounted.

9. A hanging structure configured to detachably hang a hand-held shower head having a rear side disposed with a hanging ridge that extends longitudinally and that has a convex cross section that tapers down in width from a top end to an insertion end, comprising:

a hanging structure having a front side that is disposed with a hanging groove extending in an insertion direction and having a concave cross section that tapers down in width from an insertion opening to a restricting end portion, wherein the concave cross section of the hanging groove removably accommodates the convex cross section of the hanging ridge when the insertion end of the hanging ridge is inserted into the insertion opening of the hanging groove and slid in the insertion direction within the hanging groove down to the restricting end portion thereof so that insertion depth of the hanging ridge into the hanging groove is restricted, so that the insertion direction is restricted, and so that a removal direction of the hanging ridge from the hanging groove is opposite the insertion direction, and wherein the hanging groove has two groove walls that taper inwardly for retaining the hanging ridge when engaged, and wherein the hanging ridge has right and left sides that protrude and engage and are supported by a respective groove wall of the two groove walls and at least one protruding block disposed on the hanging ridge that engages the hanging groove in a manner to restrict the insertion depth.

10. The hanging structure according to claim 9, wherein the front side of the hanging structure is arc shaped with an axis at the front, the rear side of the hanging structure is arc shaped with an axis at the front, and the arc shaped front side and the arc shaped rear side are movably coupled to each other.

11. The hanging structure according to claim 10, wherein the hanging groove has a depth from the insertion opening to the restricting end portion, and wherein the top end of the hanging ridge has a height above the hanging groove that is determined by the depth of the hanging groove.

12. The hanging structure according to claim 10, wherein the hanging groove and the hanging ridge are bilaterally symmetrical in relation to the insertion direction.

13. A hanging structure configured to detachably hang a hand-held shower head having a rear side disposed with a hanging ridge that extends longitudinally and that has a convex cross section that tapers down in width from a top end to an insertion end, comprising:

a hanging structure having a front side that is disposed with a hanging groove extending in an insertion direction and having a concave cross section that tapers down in width from an insertion opening to a restricting end portion, wherein the concave cross section of the hanging groove removably accommodates the convex cross section of the hanging ridge when the insertion end of the hanging ridge is inserted into the insertion opening of the hanging groove and slid in the insertion direction within the hanging groove down to the restricting end portion thereof so that insertion depth of the hanging ridge into the hanging groove is restricted, so that the insertion direction is restricted, and so that a removal direction of the hanging ridge from the hanging groove is opposite the insertion direction, and wherein the front side of the hanging structure is arc shaped with an axis at the front, the rear side of the hanging structure is arc shaped with an axis at the front, and the arc shaped front side and the arc shaped rear side are movably coupled to each other.

14. The hanging structure according to claim 13, wherein the hanging groove has a depth from the insertion opening to the restricting end portion, and wherein the top end of the hanging ridge has a height above the hanging groove that is determined by the depth of the hanging groove.

15. The hanging structure according to claim 13, wherein the hanging groove and the hanging ridge are bilaterally symmetrical in relation to the insertion direction.

* * * * *